US008730229B2

(12) United States Patent
Al-Dahle

(10) Patent No.: US 8,730,229 B2
(45) Date of Patent: May 20, 2014

(54) DEVICES AND METHODS FOR ZERO-BIAS DISPLAY TURN-OFF USING VCOM SWITCH

(75) Inventor: Ahmad Al-Dahle, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 286 days.

(21) Appl. No.: 13/247,876

(22) Filed: Sep. 28, 2011

(65) Prior Publication Data

US 2013/0076721 A1 Mar. 28, 2013

(51) Int. Cl.
*G09G 5/00* (2006.01)

(52) U.S. Cl.
USPC ..... 345/212; 345/87

(58) Field of Classification Search
USPC ..... 345/87, 92, 94, 98, 100, 204, 208, 211, 345/212; 323/235; 315/169.1–169.3
See application file for complete search history.

(56) References Cited

U.S. PATENT DOCUMENTS

| | | | | |
|---|---|---|---|---|
| 7,924,276 | B2 | 4/2011 | Tsuda et al. | |
| 8,144,089 | B2 * | 3/2012 | Shin et al. | 345/87 |
| 8,159,484 | B2 * | 4/2012 | Watanabe | 345/208 |
| 2003/0098934 | A1 * | 5/2003 | Lee et al. | 349/39 |
| 2005/0041004 | A1 * | 2/2005 | Gates et al. | 345/87 |
| 2005/0078073 | A1 * | 4/2005 | Mikami et al. | 345/92 |
| 2005/0200588 | A1 * | 9/2005 | Kaneda | 345/98 |
| 2007/0164952 | A1 * | 7/2007 | Kim | 345/87 |
| 2007/0296658 | A1 * | 12/2007 | Kim | 345/87 |
| 2008/0238853 | A1 * | 10/2008 | Tu et al. | 345/98 |
| 2009/0040161 | A1 * | 2/2009 | Baek et al. | 345/94 |
| 2009/0237579 | A1 | 9/2009 | Shin et al. | |
| 2011/0007060 | A1 * | 1/2011 | Jarupoonphol et al. | 345/212 |
| 2011/0148846 | A1 * | 6/2011 | Arasawa et al. | 345/212 |
| 2011/0175895 | A1 * | 7/2011 | Hayakawa et al. | 345/212 |
| 2011/0227955 | A1 * | 9/2011 | Lee et al. | 345/690 |
| 2012/0091997 | A1 * | 4/2012 | Huang | 324/123 R |
| 2013/0082994 | A1 * | 4/2013 | Al-Dahle | 345/208 |

* cited by examiner

*Primary Examiner* — Joe H Cheng
(74) *Attorney, Agent, or Firm* — Fletcher Yoder PC

(57) ABSTRACT

Methods and devices employing zero-bias display turn-off circuitry, including turn-off logic and switching devices, are provided. In one example, a method may include supplying a common voltage output of ground to a common electrode of a pixel of an electronic display, supplying an activation signal to the pixel to activate the pixel, supplying a data signal of ground to a pixel electrode of the pixel, and removing the activation signal from the pixel while the data signal is being supplied to the pixel to store the data signal in the pixel. When the activation signal is removed, the method may include causing the common voltage output being supplied to the common electrode of the pixel to change to a floating value to prevent a kickback voltage from affecting the data signal stored in the pixel.

20 Claims, 5 Drawing Sheets

DEVICES AND METHODS FOR ZERO-BIAS DISPLAY TURN-OFF USING VCOM SWITCH

BACKGROUND

The present disclosure relates generally to electronic displays and, more particularly, to liquid crystal displays (LCDs) that can be turned off in a manner that largely eliminates a bias voltage on a liquid crystal.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs), are commonly used in electronic devices such as televisions, computers, and phones. LCDs portray images by modulating the amount of light that passes through a liquid crystal layer within pixels of varying color. For example, by varying a voltage difference between a pixel electrode and a common electrode in a pixel, an electric field may result. The electric field may cause the liquid crystal layer to vary its alignment, which may ultimately result in more or less light being emitted through the pixel where it may be seen. By changing the voltage difference (often referred to as a data signal) supplied to each pixel, images may be produced on the LCD.

To store data representing a particular amount of light that is to be passed through pixels, gates of thin-film transistors (TFTs) in the pixels may be activated while the data signal is supplied to the pixels. Conventionally, when an LCD is turned off, the pixel electrodes of all pixels of the LCD may be supplied a minimal voltage. When the TFT gates are deactivated, a kickback voltage may alter the voltage stored in the pixels. The resulting voltage may be different from the supplied minimal voltage and may cause an electric field that remains in place after the LCD is turned off. This electric field may continue to impact the liquid crystal layer of the pixels of the LCD while the LCD is off. It is believed that this electric field caused by the voltage on the pixel electrodes may result in image artifacts, such as flickering, that could appear after the display is turned on again.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to devices and methods for turning off an electronic display to prevent a kickback voltage from affecting data stored in pixels when the display is turned off. By way of example, a method for turning off an electronic display may include supplying a Vcom output of ground to a common electrode of a pixel of an electronic display, supplying an activation signal to the pixel to activate the pixel, supplying a data signal of ground to a pixel electrode of the pixel, and removing the activation signal from the pixel while the data signal is being supplied to the pixel to store the data signal in the pixel. When the activation signal is removed, the Vcom output that is supplied to the common electrode of the pixel is changed to prevent a kickback voltage from affecting the data signal stored in the pixel.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
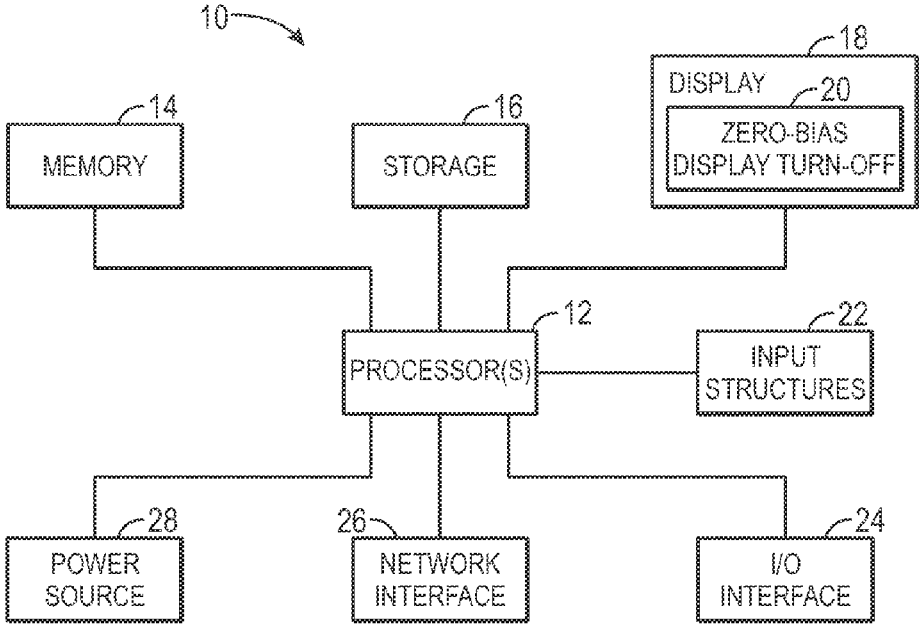
FIG. 1 is a schematic block diagram of an electronic device with a liquid crystal display (LCD) having zero-bias display turn-off circuitry, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, embodiments of the present disclosure relate to liquid crystal displays (LCDs) and electronic devices incorporating LCDs that employ a display shut-down device, method, or combination thereof. Specifically, rather than turning off an electronic display in a conventional manner, which could result in a residual voltage remaining on the pixels of the electronic display, which could in turn cause image artifacts when the display is turned back on, embodiments of the present disclosure may incorporate zero-bias display turn-off circuitry. This display turn-off circuitry is referred to as "zero-bias" because, when the electronic display is turned off, it results in a significantly reduced amount of residual voltage remaining on the pixels of the electronic display (approaching substantially zero). In fact, the amount of residual voltage remaining on the pixels may be so low as to substantially reduce the effect of any image artifacts that might otherwise form.

Specifically, to decrease the amount of residual voltage remaining on the pixels, a Vcom output of ground may be supplied to a common electrode of a pixel of an electronic display. An activation signal may be supplied to the pixel to activate the pixel. A data signal of ground may be supplied to the pixel electrode of the pixel and the activation signal may be removed from the pixel while the data signal is being supplied to the pixel to store the data signal in the pixel. When the activation signal is removed, the common electrode of the pixel may be disconnected from the Vcom voltage supply. That is, the common electrode may be "floated" or maintained in a high-Z or high-impedance configuration. It is believed that disconnecting the common electrode from the Vcom voltage supply may prevent a kickback voltage from affecting data stored in the pixel, thereby maintaining the data signal of ground on the pixel electrode. As a result, it is believed that a residual voltage may be less likely to appear on the liquid crystal after the LCD is turned off and, accordingly, image artifacts may be less likely to occur when the LCD is turned back on.

Figure 2:
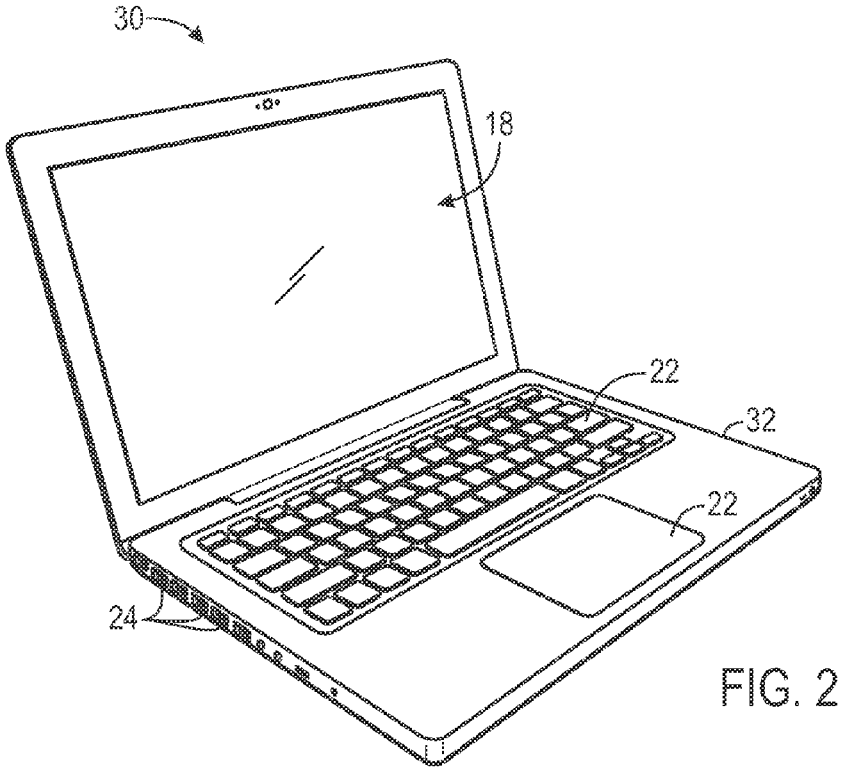
FIG. 2 is a perspective view of a notebook computer representing an embodiment of the electronic device of FIG. 1.
Figure 3:
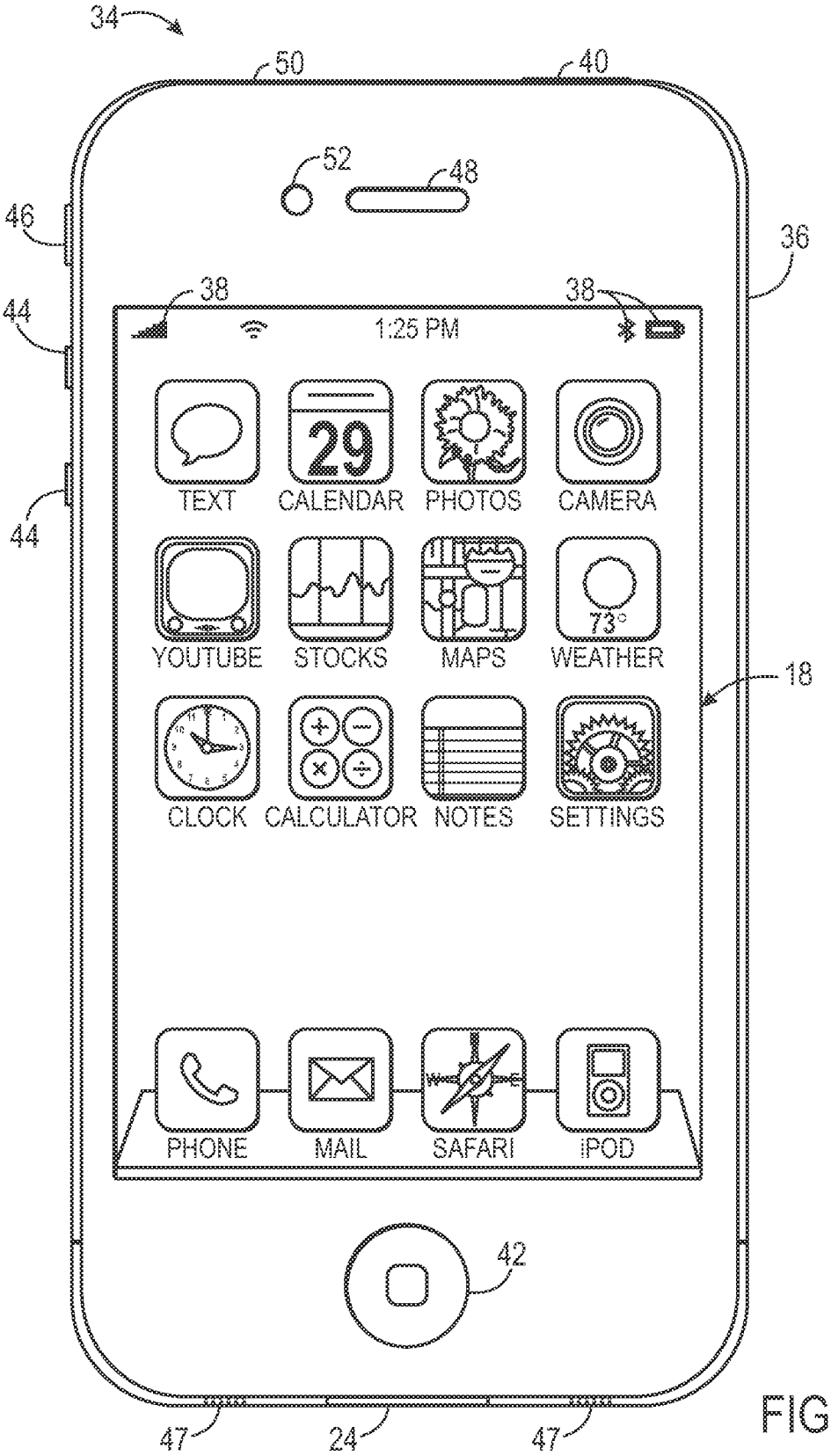
FIG. 3 is a front view of a handheld device representing another embodiment of the electronic device of FIG. 1.

With the foregoing in mind, a general description of suitable electronic devices that may employ electronic displays having zero-bias display turn-off capabilities will be provided below. In particular, FIG. 1 is a block diagram depicting various components that may be present in an electronic device suitable for use with such a display. FIGS. 2 and 3 respectively illustrate perspective and front views of a suitable electronic device, which may be, as illustrated, a notebook computer or a handheld electronic device.

Turning first to FIG. 1, an electronic device 10 according to an embodiment of the present disclosure may include, among other things, one or more processor(s) 12, memory 14, nonvolatile storage 16, a display 18 having zero-bias display turn-off circuitry 20, input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10.

By way of example, the electronic device 10 may represent a block diagram of the notebook computer depicted in FIG. 2, the handheld device depicted in FIG. 3, or similar devices. It should be noted that the processor(s) 12 and/or other data processing circuitry may be generally referred to herein as "data processing circuitry." This data processing circuitry may be embodied wholly or in part as software, firmware, hardware, or any combination thereof. Furthermore, the data processing circuitry may be a single contained processing module or may be incorporated wholly or partially within any of the other elements within the electronic device 10. As presented herein, the data processing circuitry may control the electronic display 18 by determining when the electronic display 18 is to be turned off and by issuing a turn-off or shutdown command. The turn-off or shutdown command is provided to the display 18, which uses the zero-bias display turn-off circuitry 20 to turn off the display 18 in a way that reduces the occurrence of image artifacts when the display 18 is later turned back on.

In the electronic device 10 of FIG. 1, the processor(s) 12 and/or other data processing circuitry may be operably coupled with the memory 14 and the nonvolatile memory 16 to execute instructions. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12.

The display 18 may be a touch-screen liquid crystal display (LCD), for example, which may enable users to interact with a user interface of the electronic device 10. In some embodiments, the electronic display 18 may be a MultiTouch™ display that can detect multiple touches at once. Various display components, such as turn-off logic and associated switching devices may be located within the electronic display 18. As will be described further below, the zero-bias display turn-off circuitry 20 may include circuitry for switching on or off the connection between the pixel common electrodes and a voltage source and/or increasing the impedance between the common electrodes and the voltage source. As such, it should be understood that the zero-bias display turn-off circuitry 20 may include, for example, switching devices that change the signal being supplied from the Vcom voltage source to the common electrodes in response to a shut-down command from the processor(s) 12. More specifically, when the display 18 is to be turned off, the zero-bias display turn-off circuitry 20 may cause the signal supplied to the common electrodes to switch to a high impedance, floating value, or hi-Z output. It should be noted that the terms "high impedance," "floating value," and "hi-Z" may be used interchangeably in this disclosure.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

The electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30, is illustrated in FIG. 2 in accordance with one embodiment of the present disclosure. The depicted computer 30 may include a housing 32, a display 18, input structures 22, and ports of an I/O interface 24. In one embodiment, the input structures 22 (such as a keyboard and/or touchpad) may be used to interact with the computer 30, such as to start, control, or operate a GUI or applications running on computer 30. For example, a keyboard and/or touchpad may allow a user to navigate a user interface or application interface displayed on the display 18. Further, the display 18 may include the zero-bias display turn-off circuitry 20.

FIG. 3 depicts a front view of a handheld device 34, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif. In other embodiments, the handheld device 34 may be a tablet-sized embodiment of the electronic device 10, which may be, for example, a model of an iPad® available from Apple Inc.

The handheld device 34 may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices.

User input structures 40, 42, 44, and 46, in combination with the display 18, may allow a user to control the handheld device 34. For example, the input structure 40 may activate or deactivate the handheld device 34, the input structure 42 may navigate a user interface to a home screen, a user-configurable application screen, and/or activate a voice-recognition feature of the handheld device 34, the input structures 44 may provide volume control, and the input structure 46 may toggle between vibrate and ring modes. A microphone 48 may obtain a user's voice for various voice-related features, and a speaker 50 may enable audio playback and/or certain phone capabilities. A headphone input 52 may provide a connection to external speakers and/or headphones. As mentioned above, the display 18 may include the zero-bias display turn-off circuitry 20.

Figure 4:
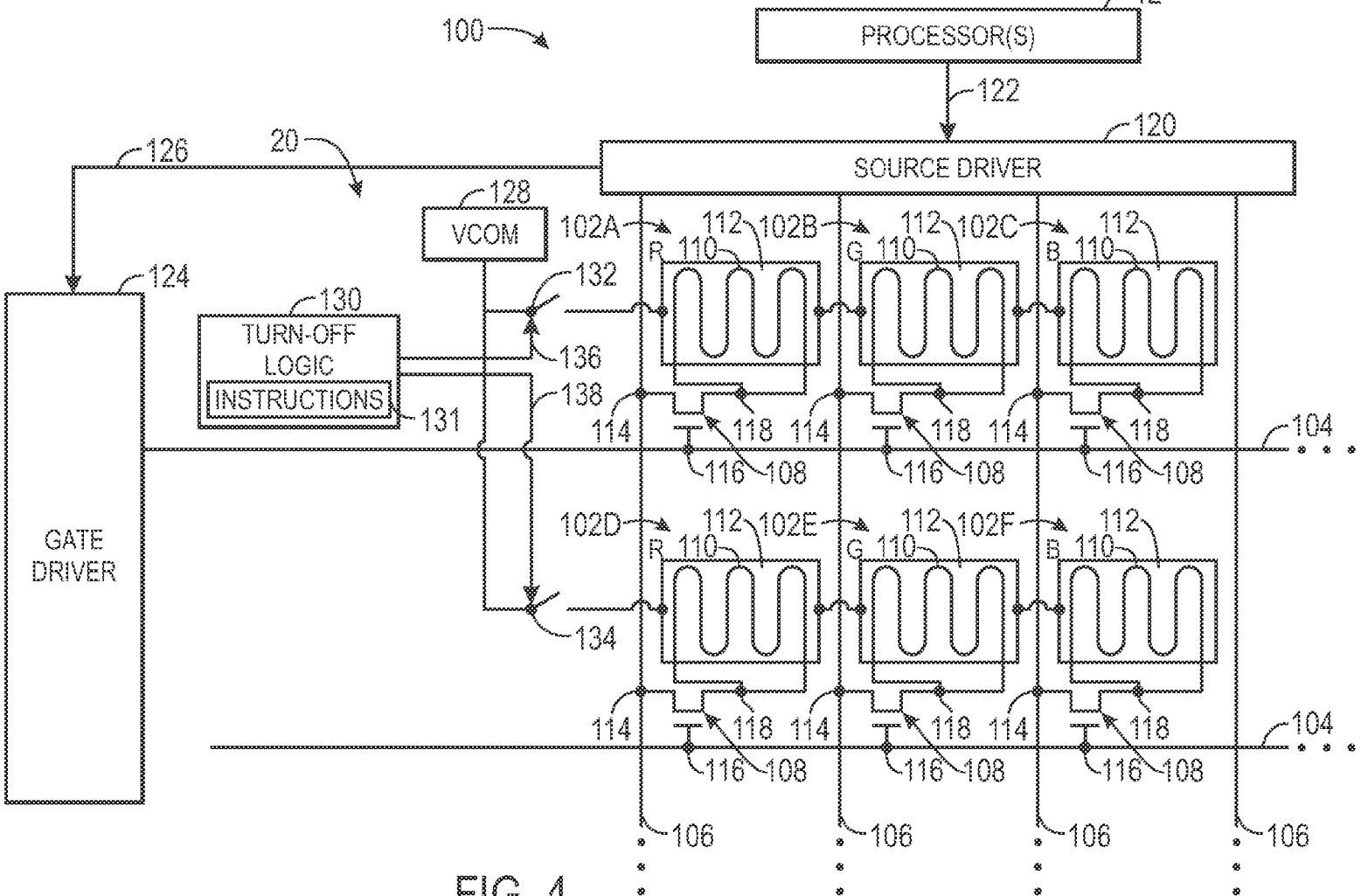
FIG. 4 is a circuit diagram illustrating display circuitry used to turn off pixels of an LCD with reduced kickback voltage, in accordance with an embodiment.

Among the various components of an electronic display 18 may be a pixel array 100, as shown in FIG. 4. FIG. 4 generally represents a circuit diagram of certain components of the display 18 in accordance with an embodiment. In particular, the pixel array 100 of the display 18 may include a number of unit pixels 102 disposed in a pixel array or matrix. In such an array, each unit pixel 102 may be defined by the intersection of rows and columns, represented by gate lines 104 (also referred to as scanning lines), and source lines 106 (also referred to as data lines), respectively. Although only six unit pixels 102, referred to individually by the reference numbers 102A-102F, respectively, are shown for purposes of simplicity, it should be understood that in an actual implementation, each source line 106 and gate line 104 may include hundreds or thousands of such unit pixels 102. Each of the unit pixels 102 may represent one of three subpixels that respectively filters only one color (e.g., red, blue, or green) of light. For purposes of the present disclosure, the terms "pixel," "subpixel," and "unit pixel" may be used largely interchangeably.

In the presently illustrated embodiment, each unit pixel 102 includes a thin film transistor (TFT) 108 for switching a data signal supplied to a respective pixel electrode 110. The potential stored on the pixel electrode 110 relative to a potential of a common electrode 112, which may be shared by other pixels 102, may generate an electrical field sufficient to alter the arrangement of a liquid crystal layer of the display 18. In the depicted embodiment of FIG. 4, a source 114 of each TFT 108 may be electrically connected to a source line 106 and a gate 116 of each TFT 108 may be electrically connected to a gate line 104. A drain 118 of each TFT 108 may be electrically connected to a respective pixel electrode 110. Each TFT 108 may serve as a switching element that may be activated and deactivated (e.g., turned on and off) for a period of time based on the respective presence or absence of a scanning or activation signal on the gate lines 104 that are applied to the gates 116 of the TFTs 108.

When activated, a TFT 108 may store the image signals received via the respective source line 106 as a charge upon its corresponding pixel electrode 110. As noted above, the image signals stored by the pixel electrode 110 may be used to generate an electrical field between the respective pixel electrode 110 and a common electrode 112. This electrical field may align the liquid crystal molecules within the liquid crystal layer to modulate light transmission through the pixel 102. Thus, as the electrical field changes, the amount of light passing through the pixel 102 may increase or decrease. In general, light may pass through the unit pixel 102 at an intensity corresponding to the applied voltage from the source line 106.

The display 18 also may include a source driver integrated circuit (IC) 120, which may include a chip, such as a processor, microcontroller, or application specific integrated circuit (ASIC), that controls the display pixel array 100 by receiving image data 122 from the processor(s) 12 and sending corresponding image signals to the unit pixels 102 of the pixel array 100. It should be understood that the source driver 120 may be a chip-on-glass (COG) component on a TFT glass substrate, a component of a display flexible printed circuit (FPC), and/or a component of a printed circuit board (PCB) that is connected to the TFT glass substrate via the display FPC. Further, the source driver 120 may include any suitable article of manufacture having one or more tangible, computer-readable media for storing instructions that may be executed by the source driver 120. The source driver 120 also may couple to a gate driver integrated circuit (IC) 124 that may activate or deactivate rows of unit pixels 102 via the gate lines 104. As such, the source driver 120 may provide timing signals 126 to the gate driver 124 to facilitate the activation/deactivation of individual rows (i.e., lines) of pixels 102. In other embodiments, timing information may be provided to the gate driver 124 in some other manner. The display 18 may include a Vcom source 128 to provide a Vcom output to the common electrodes 112. In some embodiments, the Vcom source 128 may supply a different Vcom to different common electrodes 112 at different times. In other embodiments, the common electrodes 112 all may be maintained at the same potential (e.g., a ground potential) while the display 18 is on.

During operation, a kickback voltage may occur when an activation signal is removed by the gate driver 124. That is, when the activation signal is removed, the voltage stored by the pixel electrode 110 may change by an amount substantially equal to the kickback voltage. When the display 18 is turned off, a very low voltage or ground potential may be applied to the pixel electrodes 110. Doing so may minimize the voltage difference biasing the liquid crystal between the pixel electrodes 110 and the common electrodes 112. If a kickback voltage occurs as the display 18 is being shut off, the originally applied voltage could change by the kickback voltage amount, leaving a non-zero bias voltage on the pixel electrodes 110. It is believed that this bias voltage caused by the kickback voltage could affect the liquid crystal, creating image artifacts on the display 18 for a long time (e.g., several minutes) after the display 18 is turned back on.

Accordingly, the zero-bias display turn-off circuitry 20 of the display 18 may operate using turn-off logic 130 to inhibit image artifacts from appearing on the display 18, such as when the display 18 is turned on after previously being turned off. Specifically, the zero-bias display turn-off circuitry 20 may prepare pixels to be placed in an off state when the display 18 is to be turned off by issuing control signals to change the Vcom outputs being supplied to the common electrodes 112. The turn-off logic 130 controls the operation of switches 132 and 134 using control lines 136 and 138. It should be appreciated that other switches and control lines may couple to other common electrodes 112 of other lines of pixels in the display 18, and that the switches 132 and 134 and control lines 136 and 138 are illustrated by way of example. The turn-off logic 130 may include a microcontroller or other processing device that can execute instructions 131. Further, the instructions 131 may be stored on any suitable article of manufacture that includes one or more tangible, computer-readable media, such as a memory device.

The turn-off logic 130 may send control signals to the switches 132 and 134 to control the position of the switches 132 and 134 (i.e., open or closed). In the "closed position" the switches 132 and 134 electrically connect the Vcom source 128 to the common electrodes 112. Thus, a voltage (e.g., ground) or other signal supplied by the Vcom source 128 may be received by the common electrodes 112 when the switches 132 and 134 are in the "closed position." Conversely, in the "open position" the switches 132 and 134 electrically disconnect the Vcom source 128 from the common electrodes 112. Thus, the common electrodes 112 receive a high impedance or floating value input when the switches 132 and 134 are in the "open position."

The switches 132 and 134 may be any type of switching device. For example, the switches 132 and 134 may be any suitable relay, solid state switch (e.g., a transistor), or other solid state device. As should be understood, the turn-off logic 130 may be controlled by signals from the source driver 120, the gate driver 124, the processor(s) 12, or some other device. For example, the turn-off logic 130 may receive a shut-down command from the processor(s) 12 or the source driver 120 to cause the turn-off logic 130 to change the Vcom output to a high impedance or floating value.

In the example of FIG. 4, the switch 132 may be used to control the Vcom output to one line of pixels (i.e., 102A, 102B, 102C), while the switch 134 may be used to control the Vcom output to another line of pixels (i.e., 102D, 102E, 102F). Alternatively, a single switch may be used to control the Vcom output to all pixels 102 in the electronic display 18. Further, the lines of pixels 102 in the display 18 may be controlled using the switches 132 and 134. The switches 132 and 134 may switch between the "closed position" and the "open position" consecutively or concurrently. In some embodiments, the zero-bias display turn-off circuitry 20 may not include the switches 132 and 134. In place of the switches 132 and 134, the Vcom source 128 itself may provide a high impedance or floating value to the common electrodes 112 of one or more of the lines of pixels 102. In such a configuration, the turn-off logic 130 may control when the Vcom source 128 provides a high impedance or floating value output. That is, the Vcom source 128 itself may include the capability of providing a high-impedance or floating condition to the common electrodes 112 upon receipt of a command signal.

Figure 5:
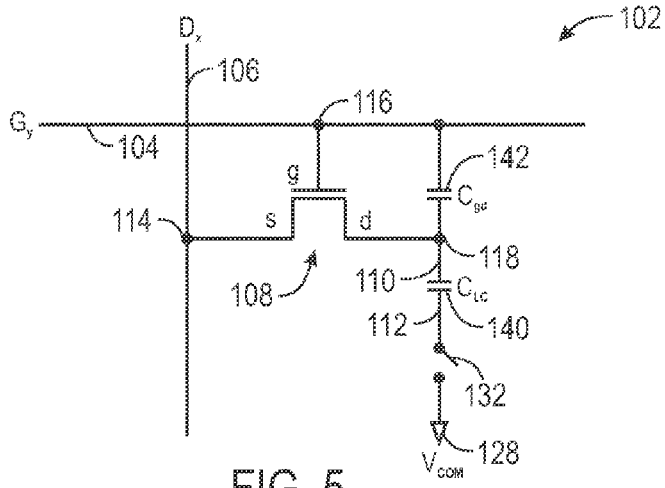
FIG. 5 is a circuit diagram of a pixel of an LCD, in accordance with an embodiment.

Within the pixel array 100, each pixel 102 stores data on the pixel electrodes 110 of the pixel. In the illustrated embodiment of FIG. 5, the pixel 102 includes the TFT 108 as previously described. The source 114 of the TFT 108 is electrically connected to the source line ($D_x$) 106 and the gate 116 of the TFT 108 is electrically connected to the gate line ($G_y$) 104. Further, the drain 118 of the TFT 108 is electrically connected to the pixel electrode 110. The switch 132 is positioned between the Vcom source 128 and the common electrode 112. As previously described, the switch 132 may be any suitable switching device that may cause the common electrode 112 to receive a high impedance or floating value input on command (e.g., a transistor). In certain embodiments, the pixel 102 may not have the switch 132 coupled between the common electrode 112 and the Vcom source 128. In such an embodiment, the Vcom source 128 may directly provide a high impedance or floating value output to the common electrode 112. A liquid crystal capacitance ($C_{LC}$) 140 may be present between the pixel electrode 110 and the common electrode 112 and a parasitic capacitance ($C_{gd}$) 142 may be present between the gate 116 and the drain 118 of the TFT 108.

During operation, the switch 132 is controlled to the "closed position" and a Vcom output is supplied by the Vcom source 128. In addition, a data signal is supplied to the source line ($D_x$) 106 and, therefore, to the source 114 of the TFT 108. An activation signal is supplied to the gate line ($G_y$) 104 to activate the gate 116 of the TFT 108. With the TFT 108 activated, the data signal supplied to the source 114 flows through the TFT 108 to the drain 118. Thus, the data signal is supplied to the pixel electrode 110. To store the data signal in the pixel electrode 110, the activation signal is removed from the gate line ($G_y$) 104 while the data signal is still being supplied to the source line ($D_x$) 106. However, when the activation signal is removed, a portion of the voltage stored by the pixel electrode 110 charges the parasitic capacitance ($C_{gd}$) 142, thereby altering the voltage stored by the pixel electrode 110. The amount of voltage change by the pixel electrode 110 after the activation signal is removed is the "kickback voltage." It is believed that this effect is facilitated by the connection of the common electrode 112 to the Vcom source 128 (e.g., the Vcom source 128 may provide a supply of charge to the common electrode 112).

The present embodiment may reduce and/or eliminate image artifacts caused by the kickback voltage remaining on the pixel electrode 110 when the display 18 is turned off by preventing the common electrode 112 from receiving charge from the Vcom source 128. When the display 18 is to be shut down, a data signal (e.g., ground, vblack, etc.) is supplied to the pixel electrode 110 as described above. It should be noted that the term "vblack" is used to refer to a specific voltage (e.g., the lowest voltage) that the source driver 120 can apply to the pixel electrode 110, often used to cause the pixel 102 to appear black. The TFT 108 is activated, and then the activation signal is removed while the data signal is still being supplied to the pixel electrode 110. At substantially the same time that the activation signal is removed, the switch 132 is controlled from the "closed position" to the "open position" to cause a Vcom output with a high impedance or a floating value to be present at the common electrode 112. This is believed to inhibit a kickback voltage from affecting the voltage across the pixel electrode 110 because the common electrode 112 does not receive charge from the Vcom source 128.

Figure 6:
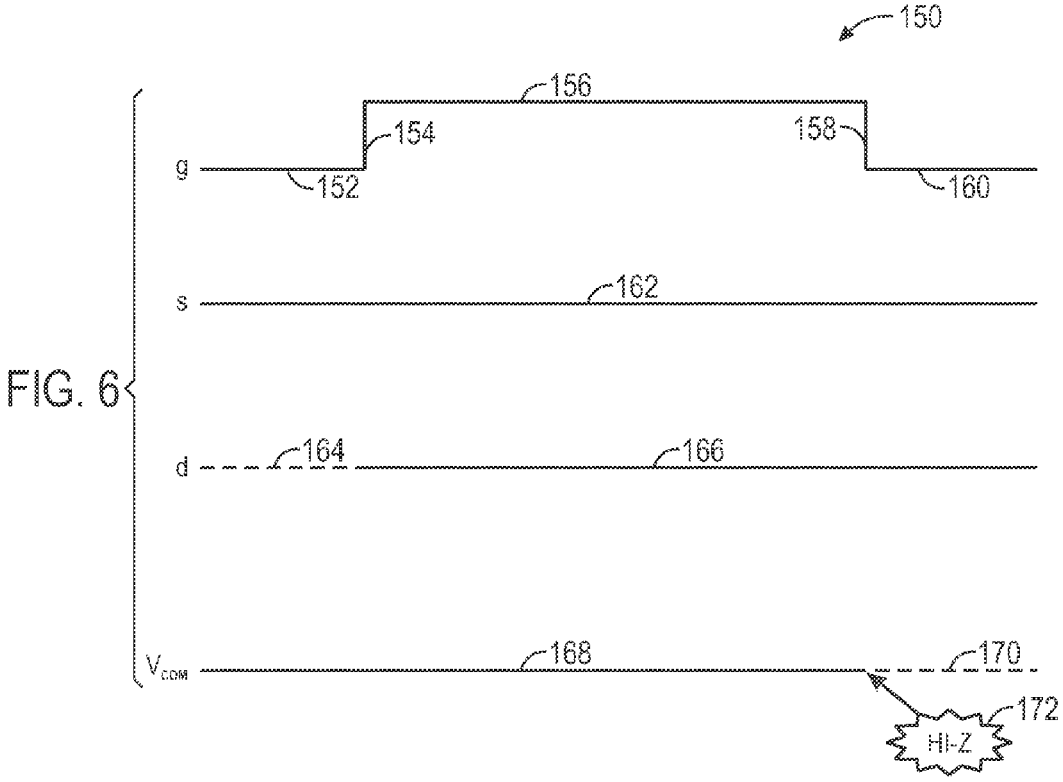
FIG. 6 is a timing diagram illustrating a zero-bias turn-off sequence to turn off pixels of an LCD with reduced kickback voltage, in accordance with an embodiment.

In some examples, the specific timing of the source signal, activation signal, and Vcom signal being supplied to the pixel 102 during shutdown may be controlled. FIG. 6 illustrates one embodiment of a timing diagram 150 that shows the timing of the signals in the pixel 102 when the display 18 is to be turned off. The signal applied to the gate 116 (i.e., the activation signal) starts in a deactivated state within segment 152. At a time 154, the signal applied to the gate 116 transitions to the activated state throughout segment 156. Then, at a time 158, the signal applied to the gate 116 transitions to the deactivated state for segment 160.

In the illustrated embodiment, a signal (e.g., ground or a low/minimum voltage) applied to the source 114 of the TFT 108 remains constant throughout the segment 162. Therefore, the signal applied to the source 114 is the same before the activation signal is supplied and after the activation signal is removed (i.e., before time 154 and after time 158, respectively). It should be noted that the signal applied to the source 114 does not necessarily need to remain at a constant level as illustrated. Specifically, the signal applied to the source 114 should be applied while the activation signal is present (i.e., while the gate 116 of the TFT 108 is activated) for a time period sufficient to cause the signal to be present on the drain 118 of the TFT 108 and to be stored in the pixel electrode 110. Further, the signal applied to the source 114 should continue to be applied until the activation signal is removed. As may be appreciated, the signal applied to the source 114 may be any suitable value that will result in a value of approximately zero volts on the pixel electrode 110. For example, the signal applied to the source 114 may be ground or vblack when the display 18 is to be shut down.

The signal present at the drain 118 is illustrated with two segments 164 and 166. At segment 164, the signal present at the drain 118 could be set at any level. Then, at time 154 when the activation signal is supplied, the signal present on the drain 118 is set by the signal on the source 114 (i.e., ground or vblack in this embodiment) as shown by segment 166. The signal present on the drain 118 remains substantially constant throughout segment 166, even after the activation signal is removed at time 158. It should be noted that the effects of a kickback voltage are not seen at the signal on the drain 118 when the activation signal is removed at time 158. Indeed, in the present embodiment, the Vcom output may inhibit a kickback voltage from occurring.

The Vcom output that is present at the common electrode 112 is illustrated by the Vcom line segments 168 and 170. The Vcom output remains at a set value throughout segment 168. At time 158 when the activation signal is removed, the Vcom output is switched to a hi-Z output 172. Thus, after time 158, the Vcom output is a high impedance, floating value, or hi-Z output throughout segment 170. Therefore, the kickback voltage does not appear on the signal present at the drain 118. As may be appreciated, the Vcom output present throughout segment 168 may be any suitable value. For example, in certain embodiments, the Vcom output may be ground.

Figure 7:
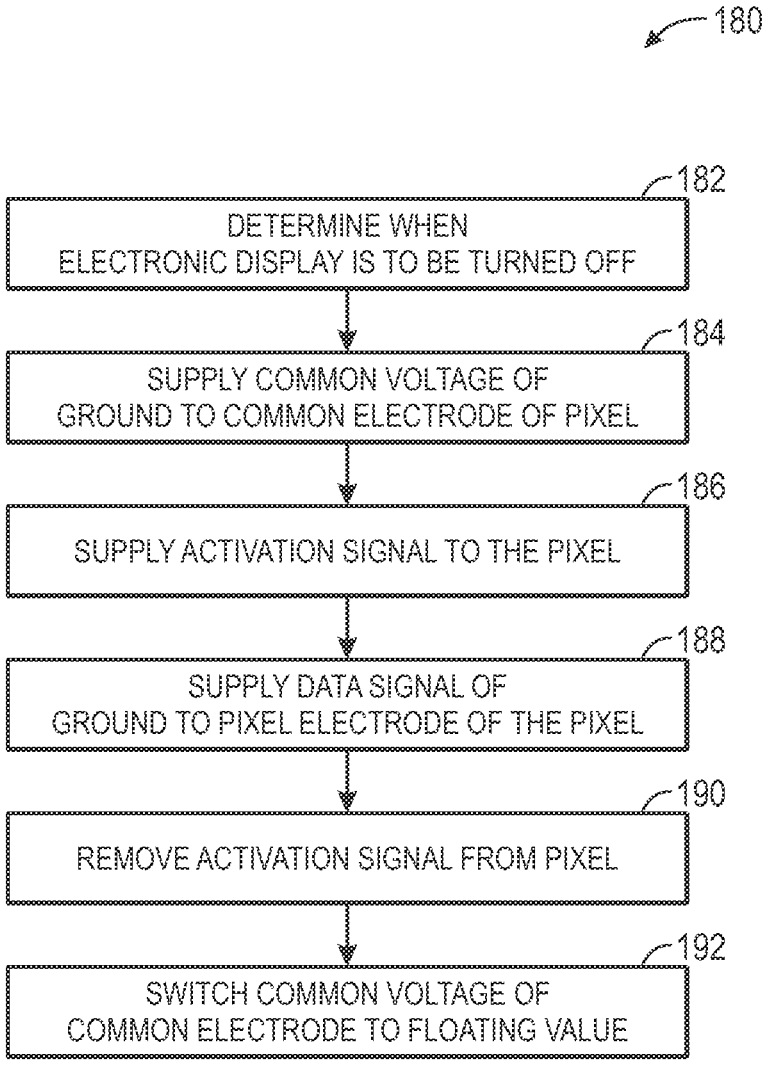
FIG. 7 is a flowchart describing a method for turning off a pixel in an LCD with reduced kickback voltage, in accordance with an embodiment.

As presented, the display 18 is shut down using a series of operations that may inhibit image artifacts from appearing when the display 18 is subsequently turned back on. FIG. 7 illustrates one embodiment of a method 180 for turning off one or more pixels 102 of the display 18. At block 182, data processing circuitry, or other control circuitry, determines when the display 18 is to be turned off. Then, at block 184 display circuitry, such as the Vcom source 128, supplies a Vcom output of ground to the common electrode 112 of the pixel 102. As may be appreciated, in some embodiments, the Vcom output supplied to the common electrode 112 is some voltage other than ground.

Next, at block 186, display circuitry, such as the gate driver 124, supplies an activation signal to the pixel 102 to activate the pixel. The activation signal enables a data signal to travel from the source 114 of the TFT 108 to the drain 118 of the TFT 108. At block 188, display circuitry, such as the source driver 120, supplies a data signal of ground to the pixel electrode 110 of the pixel 102. In some embodiments, the data signal may be vblack or another suitably low value. Then, at block 190, display circuitry, such as the gate driver 124, removes the activation signal from the pixel 102 while the data signal is being supplied to the pixel 102 to store the data signal in the pixel 102. Thus, the data signal is stored in the pixel electrode 110. Next, at block 192, when the activation signal is removed from the pixel 102, display circuitry, such as turn-off logic 130, switches the Vcom output being supplied to the common electrode 112 of the pixel 102 to change to a floating value or a high impedance to prevent a kickback voltage from appearing on the pixel electrode 110 of the pixel 102. Switching the Vcom output being supplied to the common electrode 112 may include sending a control signal to a switching device, or sending a control signal to a solid state device to cause the Vcom output to change to a floating value or high impedence. In some embodiments, the activation signal may be removed and the Vcom output may be supplied to the common electrode 112 at substantially the same time. Although the method 180 is presented in relation to turning off one pixel, similar operations may be implemented for turning off lines of pixels or for turning off a complete display of pixels. In implementing such additional operations, lines of pixels may be turned off separately or concurrently (i.e., substantially the same time).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method comprising:

supplying a common voltage output of ground to a common electrode of a pixel of an electronic display;

supplying an activation signal to the pixel to activate the pixel while the common voltage output of ground is supplied to the common electrode;

supplying a data signal of substantially ground to a pixel electrode of the pixel while the common voltage output of ground is supplied to the common electrode;

removing the activation signal from the pixel while the data signal is being supplied to the pixel to store the data signal in the pixel; and during the period in which the activation signal is removed, causing the common voltage output being supplied to the common electrode of the pixel to change to a floating value to inhibit a kickback voltage from affecting the data signal stored in the pixel.

2. The method of claim 1, wherein causing the common voltage output being supplied to the common electrode of the pixel to change to a floating value comprises sending a control signal to a solid-state switching device that causes the common voltage output being supplied to the common electrode of the pixel to change to the floating value.

3. The method of claim 1, wherein causing the common voltage output being supplied to the common electrode of the pixel to change to a floating value comprises changing a switch that causes the common voltage output being supplied to the common electrode of the pixel to change to the floating value.

4. The method of claim 1, comprising supplying a shut-down command to the electronic display to turn off the display.

5. The method of claim 1, wherein removing the activation signal from the pixel and causing the common voltage output being supplied to the common electrode of the pixel to change to a floating value occur at substantially the same time.

6. An electronic display comprising:

a plurality of pixels, each pixel having a common electrode and a pixel electrode;

a common voltage source configured to supply common voltage outputs to the common electrodes of the pixels;

a gate driver configured to supply activation signals to the pixels to activate the pixels;

a source driver configured to supply data signals to the pixel electrodes when the pixels are activated; and display turn-off circuitry configured to prepare pixels to be placed in an off state when the display is to be turned off, by issuing control signals to change the common voltage outputs being supplied to the common electrodes;

wherein, when the display is to be turned off, the common voltage source supplies common voltage outputs of ground to the common electrodes of the pixels, the gate driver supplies activation signals to the pixels while the common voltage outputs of ground are supplied to the common electrodes, the source driver supplies data signals of ground to the pixel electrodes while the common voltage outputs are at ground to store the data signals in the pixel electrodes, the gate driver removes the activation signals from the pixels, and the display turn-off circuitry causes the common electrodes of the pixels to be disconnected from the common voltage source when the gate driver removes the activation signals from the pixels to inhibit a kickback voltage from affecting data stored in the pixels.

7. The electronic display of claim 6, wherein, when the display is being turned off, the source driver supplies data signals of ground to the pixel electrodes.

8. The electronic display of claim 6, wherein, when the display is being turned off, the source driver supplies data signals of vblack to the pixel electrodes.

9. The electronic display of claim 6, wherein the display turn-off circuitry is configured to issue control signals to cause one or more solid state devices to switch states to change the common voltage outputs being supplied to the common electrodes.

10. An electronic device comprising:

an electronic display configured, when the electronic display is to be turned off, to receive a shut-down command and, in response to the shut-down command, cause a plurality of pixel electrodes to store a data signal of ground and cause common voltage outputs being supplied to common electrodes of the pixels to change while the plurality of pixel electrodes store the data signal of ground to inhibit a kickback voltage from affecting the data signals stored in the pixels; and data processing circuitry configured to control the electronic display by determining when the electronic display is to be turned off and issuing the shut-down command.

11. The electronic device of claim 10, wherein the electronic display comprises display turn-off circuitry configured to prepare pixels to be placed in an off state when the display is being turned off by issuing control signals to change the common voltage outputs being supplied to the common electrodes to inhibit the kickback voltage from affecting the data signals stored in the pixels.

12. The electronic device of claim 10, wherein the electronic display comprises display turn-off circuitry configured to receive the shut-down command, cause the plurality of pixel electrodes to store a data signal of ground, and cause common voltage outputs being supplied to the common electrodes of the pixels to change.

13. The electronic device of claim 10, wherein the electronic display is configured to cause common voltage outputs being supplied to common electrodes of the pixels to change to a high impedance to inhibit the kickback voltage from affecting the data signals stored in the pixels.

14. The electronic device of claim 10, wherein the electronic display comprises one or more solid state devices to change the common voltage outputs being supplied to the common electrodes of the pixels to inhibit the kickback voltage from affecting the data signals stored in the pixels and the shut-down command causes the solid state devices to switch states.

15. An article of manufacture comprising:

one or more tangible, non-transitory machine-readable media having instructions encoded thereon for execution by a processor, the instructions comprising:

instructions to determine when to shut down an electronic display; and instructions to cause, when the display is to be shut down, common voltage outputs of ground to be supplied to common electrodes of a plurality of pixels of the electronic display, activation signals to be supplied to the pixels to activate the pixels while the common voltage outputs of ground are supplied to the common electrodes, data signals of ground to be supplied to pixel electrodes of the pixels while the common voltage outputs of ground are supplied to the common electrodes, the activation signals to be removed from the pixels while the data signals are being supplied to the pixels to store the data signals in the pixels, and the common voltage outputs being supplied to the common electrodes of the pixels to change to a floating value to inhibit a kickback voltage from affecting the data signals stored in the pixels when the activation signals are removed.

16. A method comprising:

turning off a first line of pixels by:

supplying a first common voltage output of ground to a first common electrode of the first line of pixels of an electronic display;

supplying a first activation signal to a first gate line to activate the first line of pixels while the first common voltage output of ground is supplied to the first common electrode of the first line of pixels;

supplying data signals of ground to pixel electrodes of the first line of pixels while the first common voltage output of ground is supplied to the first common electrode of the first line of pixels;

removing the first activation signal from the first gate line while the data signals are being supplied to the pixels to store the data signals in the first line of pixels; and during the period in which the first activation signal is removed from the first gate line, causing the first common voltage output being supplied to the first common electrode to change to a floating value to inhibit a kickback voltage from affecting the data signals stored in the first line of pixels; and turning off a second line of pixels by:

supplying a second common voltage output of ground to a second common electrode of the second line of pixels of the electronic display;

supplying a second activation signal to a second gate line to activate the second line of pixels while the second common voltage output of ground is supplied to the second common electrode of the second line of pixels;

supplying data signals of ground to pixel electrodes of the second line of pixels while the second common voltage output of ground is supplied to the second common electrode of the second line of pixels;

removing the second activation signal from the second gate line while the data signals are being supplied to the pixels to store the data signals in the second line of pixels; and during the period in which the second activation signal is removed from the second gate line, causing the second common voltage output being supplied to the second common electrode to change to a floating value to inhibit a kickback voltage from affecting the data signals stored in the second line of pixels.

17. The method of claim 16, wherein turning off the first line of pixels occurs prior to turning off the second line of pixels.

18. The method of claim 16, wherein turning off the first line of pixels occurs at substantially the same time as turning off the second line of pixels.

19. The method of claim 16, comprising turning off the first line of pixels, the second line of pixels, and all other lines of pixels of the electronic display at substantially the same time.

20. The method of claim 16, wherein the first common voltage output and the second common voltage output are supplied by a common voltage source.

* * * * *